United States Patent [19]

Wallington

[11] Patent Number: 4,728,956

[45] Date of Patent: Mar. 1, 1988

[54] RECEIVERS AND TRANSMITTERS

[75] Inventor: John R. Wallington, Ipswich, United Kingdom

[73] Assignee: The Marconi Company Limited, Stanmore, England

[21] Appl. No.: 562,285

[22] Filed: Dec. 16, 1983

[30] Foreign Application Priority Data

Dec. 16, 1982 [GB] United Kingdom ..... 8235855

[51] Int. Cl.[4] ..... H01Q 3/26

[52] U.S. Cl. ..... 342/371; 342/368; 342/373; 342/377

[58] Field of Search ..... 343/437, 444, 463, 464, 343/465, 368, 371, 372, 373, 377, 824

[56] References Cited

U.S. PATENT DOCUMENTS

| | | | |
|---|---|---|---|
| 3,056,961 | 10/1962 | Mitchell | 343/374 |
| 3,293,648 | 12/1966 | Kuhn | 343/368 |
| 3,323,127 | 5/1967 | Vogel | 343/824 |
| 4,101,902 | 7/1978 | Trigon | 343/374 |
| 4,189,733 | 2/1980 | Malm | 343/368 |
| 4,321,605 | 3/1982 | Lopez | 343/368 |
| 4,544,925 | 10/1985 | Drabowitch et al. | 343/371 |

FOREIGN PATENT DOCUMENTS

| | | |
|---|---|---|
| 496027 | 3/1938 | United Kingdom . |
| 1124266 | 8/1968 | United Kingdom . |
| 1202769 | 7/1970 | United Kingdom . |
| 1204342 | 9/1970 | United Kingdom . |
| 1405241 | 8/1975 | United Kingdom . |
| 1553916 | 4/1979 | United Kingdom . |
| 1558794 | 9/1980 | United Kingdom . |
| 2068644 | 1/1981 | United Kingdom . |

OTHER PUBLICATIONS

"Introduction to Radar Systems," 2nd ed. by M. I. Skolnik, pp. 160–161, 190–222, 278–279.

Von R. Reitzig, "Bedingungen an eine leitungsgespeiste Antenne . . . ," Frequenz, vol. 26, No. 4 (Apr. 1972), pp. 93–99.

Detlev Borgmann, "Steuerung und Formung . . . ," Wissenschaftliche Berichte AEG-Telefunken, vol. 54, No. ½ (1981), pp. 25–43.

*Primary Examiner*—Theodore M. Blum
*Assistant Examiner*—David Cain
*Attorney, Agent, or Firm*—Spencer & Frank

[57] ABSTRACT

Conventionally, if several tasks have to be carried out simultaneously by receivers and transmitters, then a number of them are required, each having its own antenna.

By employing the invention a single receiver or transmitter having one antenna can carry out a number of simultaneous tasks.

A receiver has an array of antenna elements which receives signals and transmits them along conductors. Junctions include variable control means to apply a variable proportion of the signals on a conductor to one of a series of channels, each junction also giving a particular variable phase shift. By correctly selecting the amplitude and phase shift the outputs on the channels correspond to signals from respective directions of sensitivity of the receiver, and may be considered to represent a number of beams.

28 Claims, 4 Drawing Figures

RECEIVERS AND TRANSMITTERS

BACKGROUND OF THE INVENTION

This invention relates to receivers and transmitters comprising a plurality of antenna elements and more particularly to those included in radar, radio or sonar systems.

Conventionally, if several tasks have to be carried out simultaneously by such receivers and transmitters, for example, tracking a number of targets or tracking a target whilst searching for other targets, then a number of receivers or transmitters are required, each having its own antenna.

SUMMARY OF THE INVENTION

According to a first aspect of the invention a receiver comprises a plurality of antenna elements connected to respective conductors. Each of a plurality of channels has junctions with respective conductors and at each of the junctions there is variable control means for controlling the amplitude and phase of a signal fed from the conductor to the channel. The amplitude and phase controls are selected so that the signal carried by a channel represents a receiver 'beam', i.e. it has a sensitivity to signals received from a certain direction or directions, and receiver beams on respective channels may be independently steerable.

According to a second aspect of the invention, a transmitter comprises an antenna having a plurality of antenna elements connected to respective conductors. Each of a plurality of channels has junctions with respective conductors and at each of the junctions there is variable control means for controlling the amplitude and phase of a signal fed from the first channel to each conductor. The control means are selected such that a combination of signals fed from a channel to the conductors represents radiation transmitted in a particular direction, or directions, and such a transmitted beam is independently steerable from a beam derived from another channel.

By employing the invention in a receiver it is possible to obtain, on what have been termed the "channels", separate signals received simultaneously from different directions as might conventionally have been obtained from separate antennas. By employing the invention in a transmitter it is possible to transmit simultaneous signals in different directions as might conventionally have been done using separate antennas.

The adjustability provided by the variable control means results in a steerable beam on transmission, or the equivalent on reception and, in conjunction with the provision of a plurality of beams, enables for example a number of targets to be tracked simultaneously, in a manner which would have been difficult or impossible with a single antenna using conventional techniques.

Since the control means are variable they can all be made to the same specification and this makes it practical to use integrated circuit techniques. For example, each junction can be formed entirely by a single integrated circuit.

It is preferred to include unidirectional devices (e.g. amplifiers) at each junction to prevent reverse flow of reflected signals along what have been termed "conductors" and "channels". Preferably the unidirectional devices are designed to allow adjustments to the magnitude and a phase shift of energy passed through them.

This can give greater flexibility in controlling the signals at each junction.

Means are preferably included for allocating different functions to outputs from respective channels. These functions may include tracking targets, and searching for targets and sending and receiving messages.

It is also preferred that means are included for adjusting the control means associated with at least one "channel" in dependence on an output from that channel or another channel. For example, one channel could be used as a search channel and when a target is located by the search another channel can be allocated to track it. In such an apparatus, means may be included for varying the variable control means associated with one channel in a predetermined repeated sequence whereby the beam on that channel is swept through a search pattern, and also means included for detecting a target response from such a search and means included for varying the variable control means associated with another channel to cause the beam to track the target.

A receiver or transmitter in accordance with the invention typically receives or transmits microwave, or r.f., energy. However, it may operate at other wavelengths. For example, acoustic wavelengths for use in sonar equipment, X-rays, light or ultrasonics in, say, body scanning techniques, may be employed in such a receiver or transmitter.

BRIEF DESCRIPTION OF DRAWINGS

One way in which the invention may be performed will now be described by way of example with reference to the accompanying drawings in which.

DESCRIPTION OF THE DRAWINGS

Figure 1:
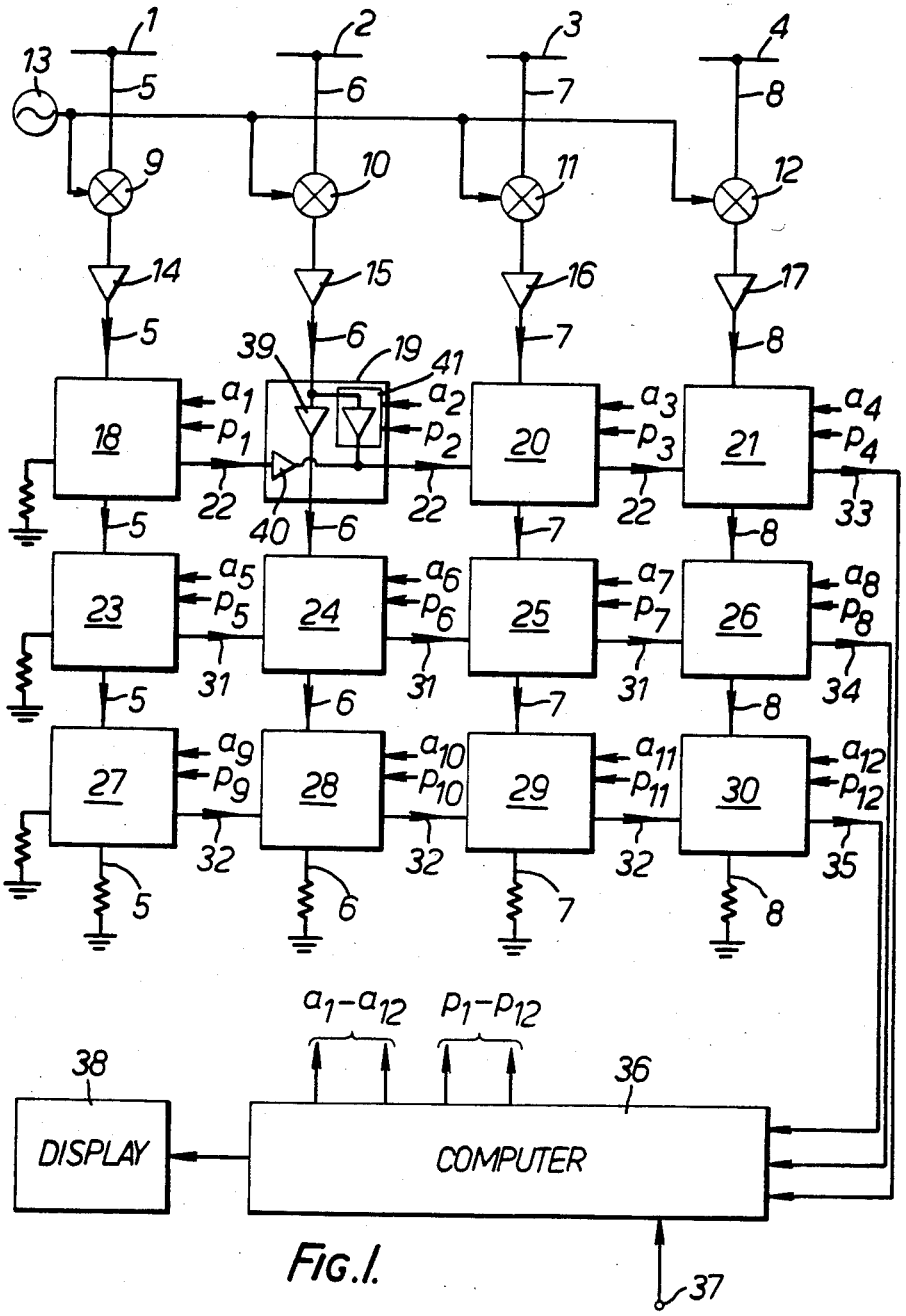
FIG. 1 is a schematic diagram of apparatus in accordance with the invention.

With reference to FIG. 1, a radar receiver has a plurality of antenna elements, only four, 1, 2, 3 and 4 of which are shown, forming a conventional linear phased array, as for example, described in "Introduction to Radar Systems" 2nd ed. by M. I. Skolnik, p. 278. The elements 1, 2, 3 and 4 are connected to respective conductors 5, 6, 7 and 8 which are capable of conducting signals received by the elements 1, 2, 3 and 4.

After being received, the signals are mixed at mixers 9, 10, 11 and 12 with signals from a local oscillator 13 to bring them to i.f. and then amplified by amplifiers 14, 15, 16 and 17 on conductors 5, 6, 7 and 8 respectively.

The outputs of the amplifiers 14, 15, 16 and 17 are applied to the inputs of four junctions 18, 19, 20 and 21 respectively.

There are junctions on each of the four conductors, 5, 6, 7 and 8, only three of which per conductor are shown. Thus, in addition to junctions 18, 19, 20 and 21, there are also junctions 23 to 30, giving a total of twelve.

A channel 22 connects the first junctions 18, 19, 20 and 21 which follow the amplifiers 14, 15, 16 and 17 on each of the conductors 5, 6, 7 and 8. Another channel 31 connects the second junctions 23, 24, 25 and 26 and a third channel 32 connects the third junctions 27, 28, 29 and 30 following the amplifiers 14, 15, 16 and 17 on each of the conductors 5, 6, 7 and 8. Again, only some channels of a plurality of channels are illustrated.

Each junction thus has two inputs and two outputs, one of the inputs being a conductor and one a channel and similarly for the two outputs. The junctions ae identical, each acting to give a signal from the appropriate conductor a certain amplitude and phase shift and then to apply it to the appropriate channel where the signals from all junctions associated with that channel are mixed together. The signal on the conductor at the input to the junction is also applied, without any phase shift, to the conductor output. Each junction has control lines to control the amplitude and phase shift selected, the amplitude control being given on lines $a_1$ to $a_{12}$, and the phase shift control on line $p_1$ to $p_{12}$. Each of the control lines $a_1$ to $a_{12}$ and $p_1$ to $p_{12}$ may be single lines, although they are preferably a plurality of lines. The control lines $a_1$ to $a_{12}$ and $p_1$ to $p_{12}$ are electrically conducting in this embodiment, but alternatively they may be optical lines. These controls are generated by a computer 36 and are set to that the outputs of channels 22, 31 and 32, which are applied to the computer 36 on lines 33, 34 and 35 respectively, represent responses of the receiver in respective directions. The controls $a_1$ to $a_{12}$ and $p_1$ to $p_{12}$ may be varied by the computer to alter the directions in which the receiver is sensitive.

The junction 19 (which is identical to the other junctions) is an integrated circuit and includes a circuit 41 which receives the amplitude and phase shift controls at lines $a_2$ and $p_2$ from the computer 36 and applies the appropriate values to the signal it receives on conductor 6.

The signal resulting from the circuit 41 is then applied to channel 22. Two unidirectional devices in the form of amplifiers 39 and 40 on conductor 6 and channel 22 respectively allow the passage of signals in one direction only, and in that direction have a gain of one and impose zero phase shift.

Channel 22 acts as a search channel, the amplitude and phase controls $a_1$, $a_2$, $a_3$, $a_4$, $p_1$, $p_2$, $p_3$, $p_4$ for channel 22 being altered so that the signals transmitted along that channel and line 33 represent a changing direction of sensitivity, i.e. a sweep is performed. When a target is detected on this channel the computer 36 determines whether it is of any interest and if so assigns one of the other channels to track the target, whilst channel 22 continues its sweep.

The computer 36 has a further input 37 at which it receives information regarding the position of any jamming devices. It is able to alter the controls $a_1$ to $a_{12}$ and $p_1$ to $p_{12}$ so as to take this into account by reducing sensitivity in the appropriate direction.

The information received by the computer 36 is shown at a display 38.

The amplifiers 39 and 40 may also have gain and phase shift control. Thus if a large phase shift is required this can be carried out by the circuit 41 in conjunction with the next amplifier on the channel 22.

Figure 2:
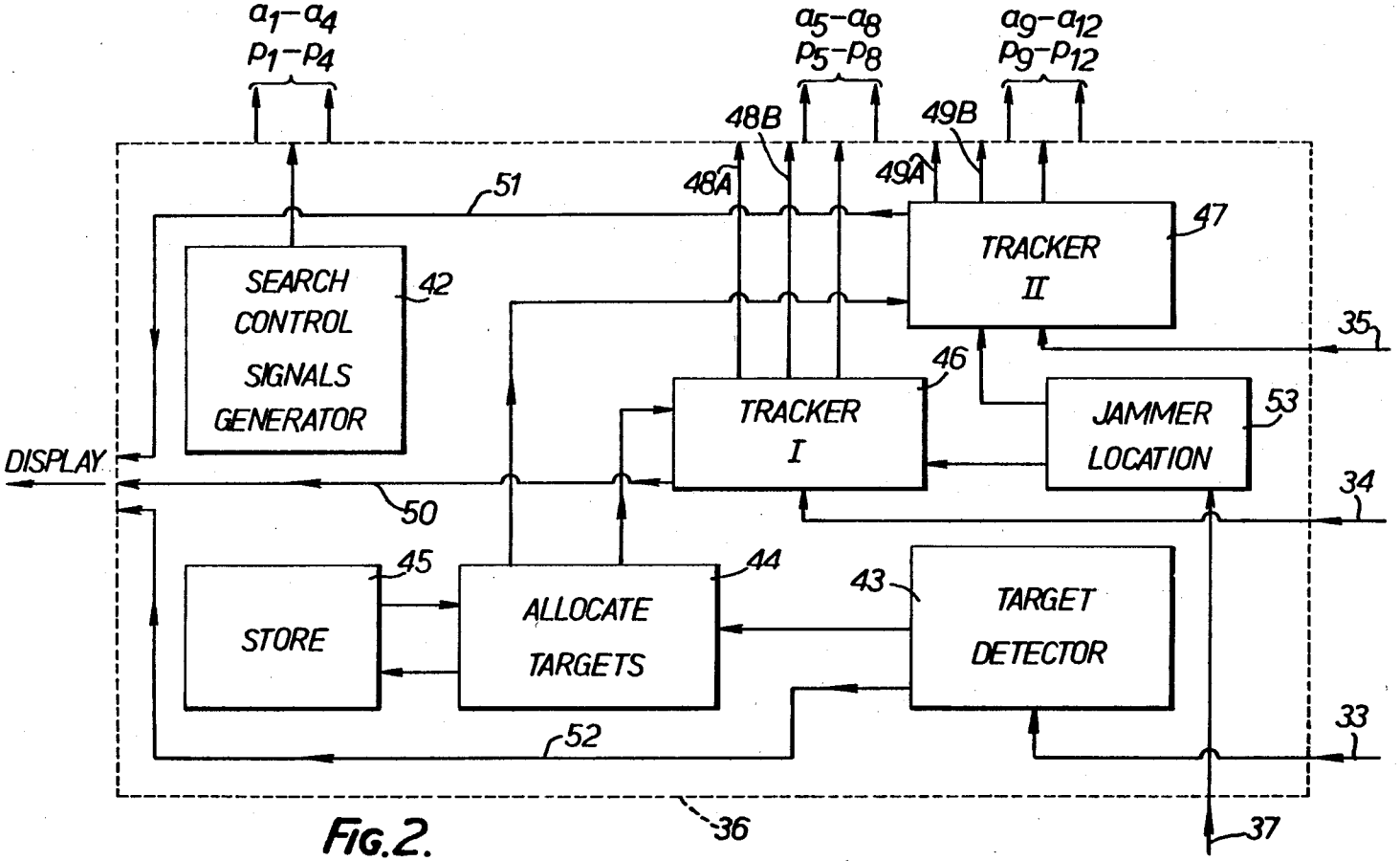
FIG. 2 shows part of the apparatus of FIG. 1 in greater detail.

The computer 36 is now described in greater detail with reference to FIG. 2.

The amplitude and phase controls $a_1$ to $a_4$ and $p_1$ to $p_4$ for the search channel 22 are generated by a search control signals generator 42.

The controls $a_1$ to $a_4$ and $p_1$ to $p_4$ are varied in a predetermined manner to produce a received beam on channel 22 which follows a desired search pattern. The generator 42 includes a store which lists the changes in the controls $a_1$ to $a_4$ and $p_1$ to $p_4$ required to steer the beam and means for reading out the contents of the store in a predetermined sequence. Such a store and readout means may be created by a person skilled in the art with little difficulty, the actual values of the controls selected depending upon the pattern required.

The received signals of the search beam transmitted along channel 22 and line 33 are applied to a target detector 43, as conventionally employed in a single channel radar receiver, which selects those responses which may indicate the presence of an interesting target by means of threshold discriminators for parameters such as range and velocity of the target. These criteria are obviously governed by the purpose for which the radar is being used, for example, where aeroplanes are to be tracked then objects having a velocity below a certain value are rejected.

When a potentially interesting target is detected, information regarding its parameters is applied to a target allocating circuit 44. This circuit 44 compares the received information with any information received earlier, which is stored in a store 45, relating to other targets, including any which are currently being tracked. Again, the criteria used to determine which of a number of targets should be tracked depend upon the application of the radar—for example a target at close range might be selected in preference to one at a greater range. This information is then stored in store 45 which is capable of storing information relating to more targets than the radar can track.

The two channels 31 and 32 other than the search channel 22 are employed for tracking targets and are associated with a first tracker 46 and a second tracker 47 respectively. Two other channels are also associated with each tracker, these not being shown in FIG. 1, the amplitude and phase control signals being applied on lines 48A and 48B and 49A and 49B.

The trackers 46 and 47 use conventional tracking techniques, such as monopulse tracking, as described in "Introduction to Radar System, 2nd ed. by M. I. Skolnik, p. 160. Since the beam shape in this case is fixed and rotates in one plane, the control signals $a_5$ to $a_8$ $p_5$ to $p_8$ and $a_9$ to $a_{12}$, $p_9$ to $p_{12}$ can be generated and stored for different orientations of the beam, a procedure which is a matter of routine for a person skilled in the art. Then an error signal produced by the tracker on receipt of a signal from the appropriate channel, giving the difference in the direction of greatest sensitivity of the receiver from the target direction, causes the amplitude and phase controls to be selected which steer the beam towards the target. Information from the trackers 46 and 47, and the signal from the search channel 22 and line 33 are passed to the display 38 on lines 50, 51 and 52 respectively.

Information regarding the location of an interfering signal may be entered on line 37 into a store 53 and applied to the two trackers 46 and 47 to minimise the beam gain in the direction of the interfering signal whilst maintaining the gain in the direction of the target so that the return from the target is maximised with respect to the interfering signal.

Figure 3:
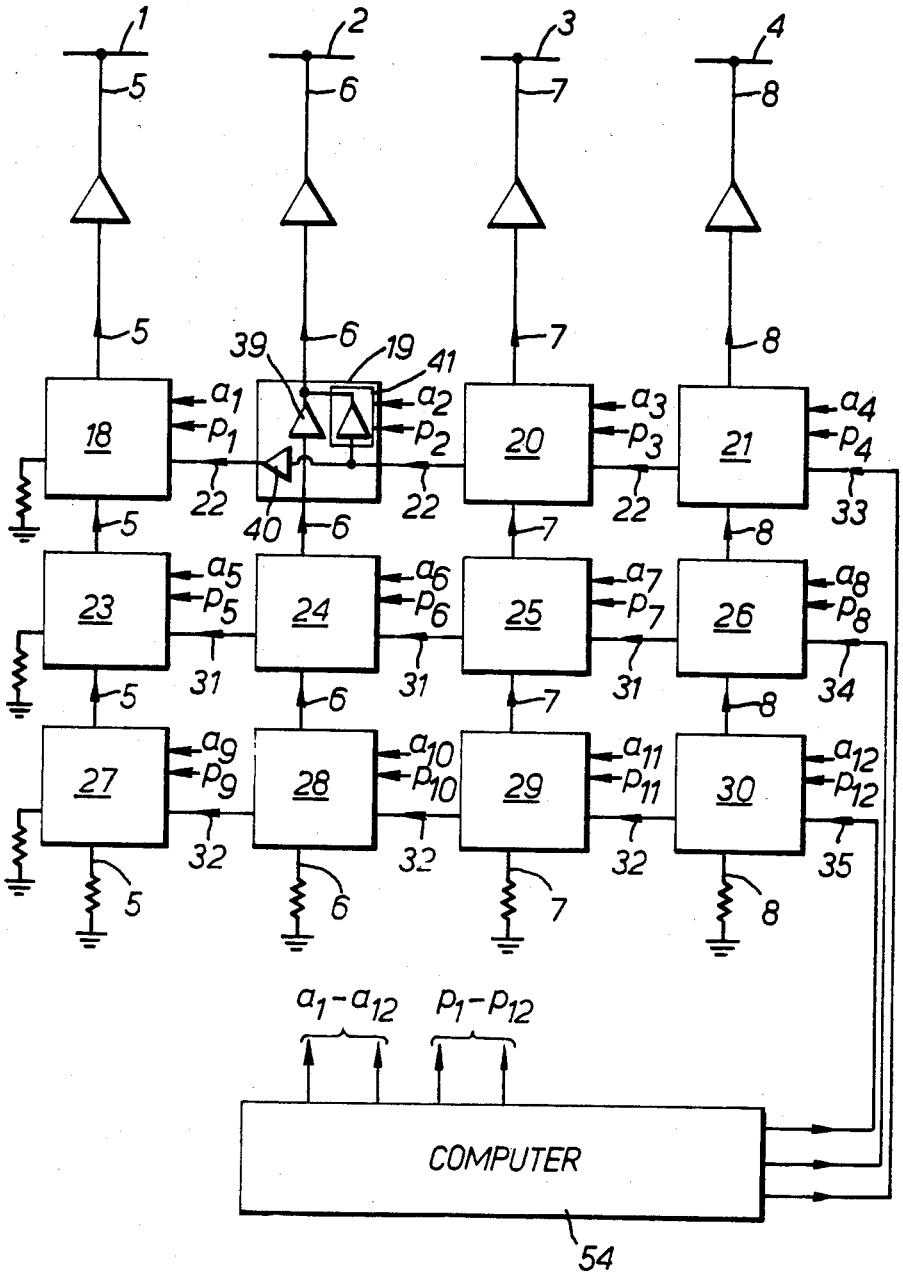
FIG. 3 is a schematic diagram of another apparatus in accordance with the invention.
Figure 4:
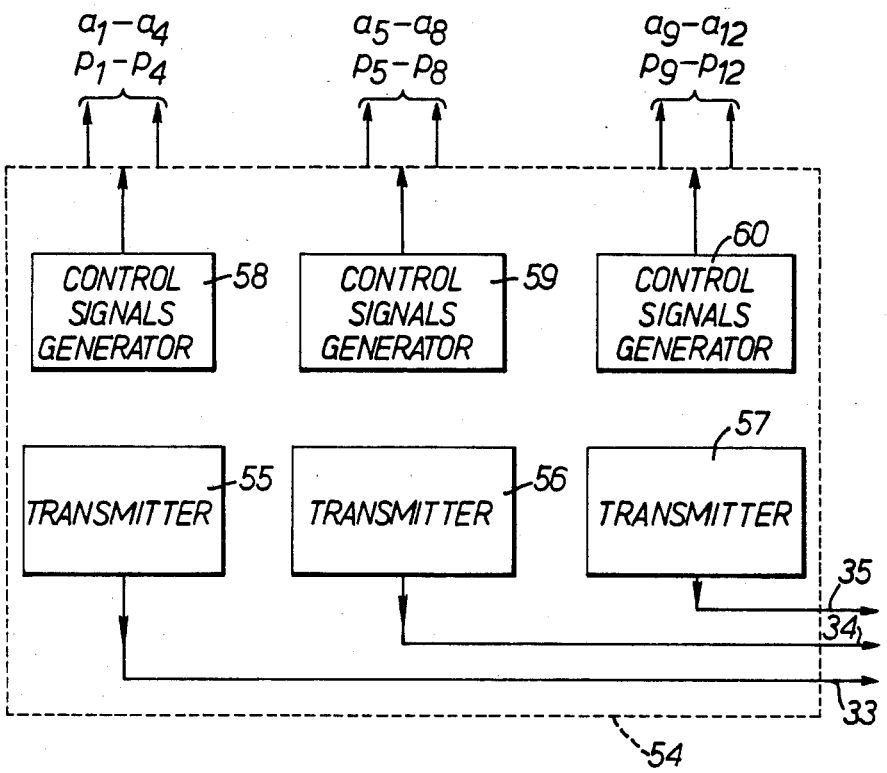
FIG. 4 shows part of the apparatus of FIG. 3 in greater detail.

A transmitter could be constructed in a similar manner to the receiver described above except that all the directional components are reversed to receive signals from the opposite direction and the mixers 9 to 12 and the local oscillator 13 are omitted, as shown in FIGS. 3 and 4. In this case, signals are transmitted along the channels 22, 31 and 32 and lines 33, 34 and 35 in the opposite direction to that in which signals in a receiver would travel. A computer 54 includes three transmitters 55, 56 and 57, each being associated with a different channel. Suitable transmitters are described in "Introduction to Radar Systems", 2nd ed. by M. I. Skolnik, in Chapter 6. The directions in which the signals are to be transmitted are controlled by amplitude and phase controls $a_1$ to $a_{12}$, and $p_1$ to $p_{12}$. These are derived from three control signal generators 58, 59 and 60 included in the computer 54, which include stores holding appropriate predetermined values, in a similar fashion to those included in the receiver described with reference to FIGS. 1 and 2. The junctions operate at r.f. instead of i.f. and could comprise Ga As Monolithic microwave integrated circuits. A plurality of beams are produced which can be independently controlled.

The above described receiver and transmitter as shown include a linear array of antenna elements to give scanning in one plane. Scanning in three dimensions may be achieved by providing a number of such linear arrays and associated circuitry, although only one computer could be used.

A receiver and transmitter can be combined for example for use in a radar system, by using two sets of components and using switching to switch between receiving and transmitting modes.

We claim:

1. A receiver of radiated signals comprising:

(a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from each conductor to the first channel, the first variable control means providing a degree of isolation, which under all conditions exceeds the maximum attenuation provided by the first variable control means by at least a factor of a hundred, between the first channel and each conductor;

(f) second variable control means at the junctions between the second channel and the conductors for independently controlling the magnitude and phase shift of a signal passed from each conductor to the second channel, the second variable control means providing a degree of isolation, which under all conditions exceeds the maximum attenuation provided by the second variable control means by a factor of at least a hundred, between the second channel and each conductor;

(g) first beam forming means arranged to control the first variable control means so that a combination of signals fed from the conductors on to the first channel represents radiation received from a first particular direction or directions determined by the first beam forming means;

(h) second beam forming means arranged to control the second variable control means so that a combination of signals fed from the conductors on to the second channel represents radiation received from a second particular direction or directions determined by the second beam forming mean; and (i) a unidirectional device associated with each junction and arranged to prevent reverse flow of signals along said first and second channels.

2. A receiver comprising: a plurality of antenna elements connected to respective conductors; a plurality of channels, each having junctions with respective conductors; variable control means at each junction for independently controlling the magnitude and phase shift of a signal passed from an appropriate conductor to an appropriate channel; and a unidirectional device associated with each junction and arranged to prevent reverse flow of signals along the conductors, whereby ecah channel carries a signal representing a receive beam, the direction, or directions, of which is independently steerable from that of beam represented by a signal or another channel, wherein for each channel the variable control means provide a degree of isolation, which under all conditions exceeds the maximum attenuation provided by the variable control means by at least a factor of a hundred, between the channel and the respective conductors.

3. A receiver as claimed in claim 1 and wherein the said unidirectional device is adjustable such that the magnitude and phase shift of energy passed therethrough are adjustable.

4. A receiver as claimed in claim 1, and wherein each said unidirectional device is included in an integrated circuit.

5. A receiver according to claim 1 and wherein said unidirectional device is an amplifier.

6. A receiver of radiated signals comprising:

(a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from each conductor to the first channel, the first variable control means providing a degree of isolation, which under all conditions exceeds the maximum attenuation provided by the first variable control means by at least a factor of a hundred, between the first channel and each conductor;

(f) second variable control means at the junctions between the second channel and the conductors for independently controlling the magnitude and phase shift of a signal passed from each conductor to the second channel, the second variable control means providing a degree of isolation, which under all conditions exceeds the maximum attenuation provided by the second variable control means by a factor of at least a hundred, between the second channel and each conductor;

(g) first beam forming means arranged to control the first variable control means so that a combination of signals fed from the conductors on to the first channel represents radiation received from a first particular direction or directions determined by the first beam forming means;

(h) second beam forming means arranged to control the second variable control means so that a combination of signals fed from the conductors on to the second channel represents radiation received from a second particular direction or directions determined by the second beam forming means; and (i) a unidirectional device associated with each junction and arranged to prevent reverse flow of signals along the plurality of conductors.

7. A receiver as claimed in claim 6 and wherein the said unidirectional device is adjustable such that the magnitude and a phase shift of energy passed therethrough are adjustable.

8. A receiver as claimed in claim 6 and wherein each said unidirectional device is included in an integrated circuit.

9. A receiver according to claim 6 and wherein the said unidirectional device is an amplifier.

10. A receiver as claimed in claim 1 and wherein the said first and second variable control means are included in an integrated circuit.

11. A receiver as claimed in claim 1 and including means for allocating different functions to outputs from respective channels.

12. A receiver as claimed in claim 1 including means for adjusting said first variable control means in dependence on an output from said first channel or said second channel.

13. A radar system, comprising: a receiver of radiated signals, said receiver including (a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from each conductor to the first channel, the first variable control means providing a degree of isolation, which under all conditions exceeds the maximum attenuation provided by the first variable control means by at least a factor of a hundred, between the first channel and each conductor;

(f) second variable control means at the junctions between the second channel and the conductors for independently controlling the magnitude and phase shift of a signal passed from each conductor to the second channel, the second variable control means providing a degree of isolation, which under all conditions exceeds the maximum attenuation provided by the second variable control means by a factor of at least a hundred, between the second channel and each conductor;

(g) first beam forming means arranged to control the first variable control means so that a combination of signals fed from the conductors on to the first channel represents radiation received from a first particular direction or directions determined by the first beam forming means;

(h) second beam forming means arranged to control the second variable control means so that a combination of signals fed from the conductors on to the second channel represents radiation received from a second particular direction or directions determined by the second beam forming means; and (i) a unidirectional device associated with each junction and arranged to prevent reverse flow of signals along said first and second channels.

14. A transmitter for transmitting signals comprising:

(a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from the first channel to each conductor, the first variable control means providing a degree of isolation, which under all conditions exceeds the maximum attenuation provided by the first variable control means by at least a factor of a hundred, between the first channel and each conductor;

(f) second variable control means at the junctions between the second channel and the conductors for independently controlling the magnitude and phase shift of a signal passed from the second channel to each conductor, the second variable control means providing a degree of isolation, which under all conditions exceeds the maximum attenuation provided by the second variable control means by at least a factor of a hundred, between the second channel and each conductor;

(g) first beam forming means arranged to control the first variable control means so that a combination of signals fed from the first channel on to the conductors represents radiation transmitted in a first particular direction or directions determined by the first beam forming means;

(h) second beam forming means arranged to control the second variable control means so that a combination of signals fed from the second channel on to the conductors represents radiation transmitted in a second particular direction or directions determined by the second beam forming means; and (i) a unidirectional device associated with each junction and arranged to prevent reverse flow of signals along said first and second channels.

15. A transmitter as claimed in claim 14 and wherein the said unidirectional device is adjustable such that the magnitude and phase shift of energy passed therethrough are adjustable.

16. A transmitter as claimed in claim 14 and wherein each said unidirectional device is included in an integrated circuit.

17. A transmitter according to claim 14 and wherein said unidirectional device is an amplifier.

18. A transmitter for transmitting signals comprising:

(a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from the first channel to each conductor, the first variable control means providing a degree of isolation. which under all conditions exceeds the maximum attenuation provided by the first variable control means by at least a factor of a hundred, between the first channel and each conductor;

(f) second variable control means at the junctions between the second channel and the conductors for independently controlling the magnitude and phase shift of a signal passed from the second channel to each conductor, the second variable control means providing a degree of isolation, which under all conditions exceeds the maximum attenuation provided by the second variable control means by at least a factor of a hundred, between the second channel and each conductor;

(g) first beam forming means arranged to control the first variable control means so that a combination of signals fed from the first channel on to the conductors represents radiation transmitted in a first particular direction or directions determined by the first beam forming means;

(h) second beam forming means arranged to control the second variable control means so that a combination of signals fed from the second channel on to the conductors represents radiation transmitted in a second particular direction or directions determined by the second beam forming means; and (i) a unidirectional device associated with each junction and arranged to prevent reverse flow of signals along the plurality of conductors.

19. A transmitter as claimed in claim 18 and wherein the said unidirectional device is adjustable such that the magnitude and phase shift of energy passed therethrough are adjustable.

20. A transmitter as claimed in claim 18 and wherein each said unidirectional device is included in an integrated circuit.

21. A transmitter according to claim 18 and wherein said unidirectional device is an amplifier.

22. A transmitter as claimed in claim 14 and wherein the said first and second control means are included in an integrated circuit.

23. A transmitter as claimed in claim 14 including means for adjusting said first variable control means in dependence on an output from said first channel or said second channel.

24. A radar system, comprising: a transmitter for transmitting signals, said transmitter including (a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from the first channel to each conductor, the first variable control means providing a degree of isolation, which under all conditions exceeds the maximum attenuation provided by the first variable control means by at least a factor of a hundred, between the first channel and each conductor;

(f) second variable control means at the junctions between the second channel and the conductors for independently controlling the magnitude and phase shift of a signal passed from the second channel to each conductor, the second variable control means providing a degree of isolation, which under all conditions exceeds the maximum attenuation provided by the second variable control means by at least a factor of a hundred, between the second channel and each conductor;

(g) first beam forming means arranged to control the first variable control means so that a combination of signals fed from the first channel on to the conductors represents radiation transmitted in a first particular direction or directions determined by the first beam forming means;

(h) second beam forming means arranged to control the second variable control means so that a combination of signals fed from the second channel on to the conductors represents radiation transmitted in a second particular direction or directions determined by the second beam forming means; and (i) a unidirectional device associated with each junction and arranged to prevent reverse flow of signals along said first and second channels.

25. A transmitter comprising: a plurality of antenna elements connected to respective conductors; a plurality of channels, each having junctions with respective conductors; variable control means at each junction for independently controlling the magnitude and phase shift of a signal passed from an appropriate channel to an appropriate conductor; and a unidirectional device associated with each junction and arranged to prevent reverse flow of signals along the conductors, whereby signals derived from one channel form a transmitted beam, the direction, or directions, of which is independently steerable from that of a beam formed by signals derived from another channel, wherein for each channel the variable control means provide a degree of isolation, which under all conditions exceeds the maximum attenuation provided by the variable control means by at least a factor of a hundred, between the channel and the respective conductors.

26. A receiver as claimed in claim 11 and including means for varying said first variable control means in a predetermined repeated sequence whereby the signals fed from the conductors on to the first channel represent a search beam; means for detecting response from a target when swept by said search beam; and means for varying said second variable control means whereby the signals fed from the conductors on to the second channel represent a tracking beam for tracking said target.

27. A receiver of radiated signals comprising:

(a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from each conductor to the first channel, the first variable control means including amplifier means for controlling the amplitude of signals passed from each conductor to the first channel;

(f) second variable control means at the junctions between the second channel and the conductors for independently controlling the magnitude and phase shift of a signal passed from each conductor to the second channel, the second variable control means including amplifier means for controlling the amplitude of signals passed from each conductor to the second channel;

(g) first beam forming means arranged to control the first variable control means so that a combination of signals fed from the conductors on to the first channel represents radiation received from a first particular direction or directions determined by the first beam forming means; and (h) second beam forming means arranged to control the second variable control means so that a combination of signals fed from the conductors on to the second channel represents radiation received from a second particular direction or directions determined by the second beam forming means.

28. A transmitter for transmitting signals comprising:

(a) an antenna having a plurality of antenna elements;

(b) a plurality of conductors connected to respective antenna elements;

(c) a first channel having junctions with the conductors;

(d) a second channel having junctions with the conductors;

(e) first variable control means at the junctions between the first channel and the conductors for independently controlling the magnitude and phase shift of a signal passed from the first channel to each conductor, the first variable control means including amplifier means for controlling the amplitude of signals passed from the first channel to each conductor;

(f) second variable control means at the junctions between the second channel and the conductors for independently controlling the magnitude and phase shift of a signal passed from the second channel to each conductor, the second variable control means including amplifier means for controlling the amplitude of signals passed from the second channel to each conductor;

(g) first beam forming means arranged to control the first variable control means so that a combination of signals fed from the first channel on to the conductors represents radiation transmitted in a first particular direction or directions determined by the first beam forming means; and (h) second beam forming means arranged to control the second variable control means so that a combination of signals fed from the second channel on to the conductors represents radiation transmitted in a second particular direction or directions determined by the second beam forming means.

* * * * *